US005491460A

United States Patent [19]

Krasser et al.

[11] Patent Number: 5,491,460

[45] Date of Patent: Feb. 13, 1996

[54] INSTRUMENT SWITCH HAVING INTEGRATED OVERCURRENT PROTECTION

[75] Inventors: Fritz Krasser, Altdorf; Wolfgang Schmidt, Berg, both of Germany

[73] Assignee: Ellenberger & Poensgen GmbH, Altdorf, Germany

[21] Appl. No.: 213,810

[22] Filed: Mar. 17, 1994

[30] Foreign Application Priority Data

Mar. 17, 1993 [DE] Germany ..... 9303919 U

[51] Int. Cl.[6] ..... H01H 71/16; H01H 61/00; H01H 71/18; H01H 3/00

[52] U.S. Cl. ..... 337/70; 335/141; 200/339; 337/128; 337/131; 337/53; 337/89

[58] Field of Search ..... 337/70, 123, 128, 337/131, 53, 59, 89, 130, 132, 135, 136; 335/17, 141; 200/339

[56] References Cited

U.S. PATENT DOCUMENTS

| | | | |
|---|---|---|---|
| 3,133,174 | 5/1964 | Creager | 200/113 |
| 3,340,374 | 9/1967 | Shiraishi et al. . | |
| 3,431,517 | 3/1969 | Ellenberger et al. . | |
| 3,544,749 | 12/1970 | DeAngelo . | |
| 3,691,499 | 9/1972 | Tyler | 337/123 |
| 4,528,538 | 7/1985 | Andersen . | |
| 4,937,548 | 6/1990 | Sdunek . | |
| 5,079,530 | 1/1992 | Tsuchiyama | 335/17 |

FOREIGN PATENT DOCUMENTS

| | | | |
|---|---|---|---|
| 8704561 | 7/1987 | European Pat. Off. . | |
| 1515533 | 7/1969 | Germany . | |
| 1513242 | 8/1970 | Germany . | |
| 386532 | 4/1965 | Switzerland | 337/131 |
| 2011722 | 7/1979 | United Kingdom . | |
| 2151406 | 7/1985 | United Kingdom . | |

OTHER PUBLICATIONS

Konstruktionselemente der Feinmechanik; Hrsg. Werner Krause; 2., stark bearbeitete Auflage; 1993.

*Primary Examiner*—Michael W. Phillips
*Assistant Examiner*—Stephen T. Ryan
*Attorney, Agent, or Firm*—Spencer & Frank

[57] ABSTRACT

An electrical instrument switch includes a rocker switch for manual on-and-off switching and that is seated in an insulation housing. Depending on the pivot position, the rocker switch moves, with a working end that dips into the housing interior, a contact bridge between the closed position of its contact and the open position of its contact. The contact bridge is electrically connected in series with a contact spring that can be triggered thermally and hence acts as an overcurrent protection. The contact spring can move between its contact position and its open position. The contact spring is mechanically prestressed in the direction of its open position. When overcurrent occurs, it is transferred out of its contact position into its open position by a thermal triggering element. A pivot of the rocker switch counter to the mechanical prestress, in the tipping direction of the contact spring, guides the contact spring from its open position back into its contact position.

28 Claims, 6 Drawing Sheets

INSTRUMENT SWITCH HAVING INTEGRATED OVERCURRENT PROTECTION

CROSS-REFERENCE TO RELATED APPLICATION

This application claims the priority of Patent Application Serial No. DE G 9,303,919.0, filed Mar. 17, 1993, in the Federal Republic of Germany, the subject matter of which is incorporated herein by reference.

BACKGROUND OF THE INVENTION

The invention relates to an instrument switch having a rocker switch seated in an insulating housing which, with a working end that dips into the housing interior, moves a contact bridge between the closed position of the contact and open position of the contact, depending on the pivot position, and having a contact spring that is connected electrically in series with the contact bridge and can be thermally triggered and hence acts as overcurrent protection.

The external electrical connections of this instrument switch are connected to one another by means of two switching elements disposed inside the insulating housing of the instrument switch and connected in series. The one switching element is a contact bridge that can move between the closed position of its contact and the open position of its contact. The contact bridge is acted upon by a manually-operated rocker switch pivotably disposed on the insulation housing, and can therefore interrupt the circuit. In this way the instrument switch can be manually turned on and off.

The second switching element acts as protection against overcurrent. It is configured as a contact spring that can be triggered thermally and, when activated, likewise interrupts the circuit. By nature the thermally-related switching movement of the contact spring to interrupt the circuit is very slow. However, the interruption of the circuit requires rapid switching movements of a switching element, particularly with stronger currents. For this purpose the overcurrent protection of an instrument switch is realized in U.S. Pat. No. 4,528,538 and U.S. Pat. No. 5,079,530 by a so-called starting mechanism. Starting mechanisms are known from W. Krause, *Konstruktions-Elemente der Feinmechanik* [Construction Elements of Precision Mechanics], pp. 521 et seq., Second Edition, Munich-Vienna, Carl-Hanser-Verlag 1993, ISBN 3-446 -16530-4. The starting mechanisms used in U.S. Pat. No. 4,528,538 and U.S. Pat. No. 5,079,530 each include an energy store in the form of a spring. The heat energy generated due to overcurrent is stored in the spring as mechanical energy. The stored energy is released at a specific point in time that is dependent upon the amount and duration of the overcurrent. Because of this, slow switching movements are converted into snap-like switching movements.

After the thermal triggering element has been activated and has interrupted the circuit, it cools again and attempts to return to its initial position. However, the circuit would then be closed again. In many cases it is desirable that the overcurrent protection not automatically re-close the circuit after the thermal triggering element has cooled. In U.S. Pat. No. 4,528,538 this automatic re-closing of the circuit is prevented by a blocking element coupled with the rocker switch. Unfortunately, the blocking element requires additional componentry for the instrument switch. The spatial arrangement of the rocker switch and the contact spring also requires a correspondingly space-consuming design of the blocking element. Moreover, the forces acting upon the blocking element require it to have stable seating. This counteracts simple handling of the rocker switch with little use of force. The wearing effect of the forces acting upon the blocking element can cause the blocking element to operate imprecisely. The reliable operation of the instrument switch can thus no longer be assured. In U.S. Pat. No. 5,079,530 the contact spring itself has a very complicated design so that it can prevent automatic re-closing of the circuit by the contact spring after a completed overcurrent trip. The complicated design makes the contact spring very susceptible to interference, which likewise impairs the functioning reliability of the instrument switch. Furthermore, as a result of the complicated design of the contact spring, only small force transmissions take place between the individual components. In its function as a switching element in a closed circuit, the contact spring therefore also only generates a low contact force. Also, the structural design of the rocker switch is made complicated so that a coupling of the rocker switch with the contact spring can be achieved.

SUMMARY OF THE INVENTION

Departing from the described drawbacks, it is the object of the invention to prevent, more simply and reliably, automatic re-closing of the circuit of the above-described instrument switch. This object is attained by an electrical instrument switch that includes a rocker switch for manual on-and-off switching and that is seated in an insulation housing. Depending on the pivot position, the rocker switch moves, with a working end that dips into the housing interior, a contact bridge between the opened position of its contact and the closed position of its contact. The contact bridge is electrically connected in series with a contact spring that can be triggered thermally and hence acts as an overcurrent protection. The contact spring can move between its contact position and its open position. The contact spring is mechanically prestressed in the direction of its open position. When overcurrent occurs, it is transferred out of its contact position into its open position by a thermal triggering element. A pivot of the rocker switch counter to the mechanical prestress, in the tipping direction of the contact spring, guides the contact spring from its open position back into its contact position.

In accordance with the invention, the contact spring is held in its open position without additional components after overcurrent trip. This is accomplished solely by the special design of the contact spring with a mechanical prestress. The dead-center position of this rocker-snap mechanism is between the contact position and the open position. The snap between the contact position and open position that occurs automatically in a starting mechanism of this type is limited such that the contact spring can only spring automatically from its contact position into the open position. For this purpose the contact spring is already prestressed ahead of time in the direction of its open position. The contact spring is therefore permanently forced to move into its open position. At a limiting temperature of the thermal triggering element, the forces generated by the mechanical prestress are greater than those holding the contact spring in its contact position. At this moment the contact spring tips into its open position. Because of the mechanical prestress, the contact spring remains securely in this position without additional components to hold it in place.

The mechanical prestress of the contact spring in its open position can only be counteracted by a pivoting of the rocker switch. The rocker switch pivot occurs in the tipping direction of the contact spring. The same directions of movement of the rocker switch and contact spring contribute to the space-saving design of the instrument switch. Without a notable increase in expenditure, the rocker switch has the effect of a button that conventionally acts upon the tip-spring mechanism of an electrical switch. During pivoting of the rocker switch, the contact bridge is simultaneously transferred from the closed position of its contact into the open position of its contact. Because of this, the circuit of the instrument switch remains uninterrupted until the occurrence of another rocker switch pivot.

The rocker switch, contact bridge and contact spring are arranged in a space-saving arrangement. This supports the small construction of the instrument switch.

The force transmission path from the rocker switch to the contact spring is smaller than the one to the contact bridge. This takes into account that, during its pivoting movements, the rocker switch actually provided for pivoting the contact bridge also includes sufficient force components to act upon the contact spring. The contact spring is therefore guided reliably back into its contact position by the rocker switch.

The spatial requirement of the instrument switch for its switching mechanism can be further reduced. Identical planes of movement of the three lever-type components also permit a transmission of force with great effectiveness. This contributes to the reliable functioning of the instrument switch.

The contact spring is secured in a mechanically stable manner and, at the same time, is sufficiently resiliently movable.

The movable contact that effects the electrical contact between the contact spring and the circuit is secured to the free end of the contact spring. The movable contact consequently has the largest possible pivot path between the contact position and open position of the contact spring. Solely by means of the clearance, the largest possible pivot path assures a very effective, galvanic separation between the movable contact of the contact spring in its open position and the contact position of the circuit. Unintentional contacting between the movable contact and the circuit is hence very effectively prevented.

The principal structural construction of the contact spring is used in an instrument switch in DE-AS 1,513,242 (U.S. Pat. No. 3,340,374) and EP-A2-0,275,517. The conducting web, which is clamped in shorter with respect to the spring webs, permits, in a technically simple manner, the mechanical prestress of the contact spring in the direction of its open position.

The present invention allows for reliable electrical contacting of the contact spring with the circuit.

Conducting webs assure a short response time of the contact spring. The instrument switch thus trips very quickly when overcurrent occurs. The conducting web material is, for example, Duratherm or CuBe. The conducting web acts as a resistance wire. The response sensitivity of this type of resistance wire is greater than that of a bimetal, further shortening the triggering time of the instrument switch. Analogously, the cooling time of the conducting web warmed by overcurrent is very short. This permits a faster return of the contact spring to its contact position by means of a rocker switch pivot.

The rocker switch acts on the contact spring in the manner of a conventional push-button. This results in greater effectiveness of the force acting on the contact spring by means of the rocker switch pivot. The contact spring is returned to its contact position with a small expenditure of force.

Good guidance of the contact spring during its return to the contact position caused by the rocker switch is assured. Mechanically unstable states of the contact spring are thus prevented.

Suitable measures are provided for converting the pivoting movement of the rocker switch into a pressing force that acts upon the contact spring counter to its mechanical prestress. For this reason a coupling element having a spring effect is included. This type of coupling element permits the coupling between the rocker switch and the contact spring, which coupling must be non-rigid, yet at the same time mechanically stable. The arrangement of the coupling element is additionally space-saving.

The reliable function of the contact bridge as a two-armed lever is assured. The spring effect of the fixing spring permits a good transmission of force from the rocker switch onto the contact bridge. Moreover, the fixing spring compensates for production tolerances of the rocker switch and the contact bridge, as well as wear exhibited by the two components, so that a constant mechanical coupling effect is maintained between the rocker switch and the contact bridge over the course of operation.

The fixing spring is secured in a mechanically stable manner to the housing of the instrument switch, and thereby supports the stable, pivotable seating of the contact bridge. The contact bridge is seated very far from the fixing end of the fixing spring. This assures sufficient pivotability of the rocker switch for acting upon the two lever arms of the contact bridge.

Good electrical contact pressure of the contact is provided bridge in the closed position of its contact. For this purpose, the spring force of the fixing spring is oriented in the direction of the closed position of the contact. The contact pressure can be improved by the corresponding working end of the rocker switch that acts upon the corresponding lever arm of the contact bridge. The fixing spring, which extends parallel to the contact bridge, additionally contributes to the small design of the instrument switch.

The fixing spring is inherently stable.

The number of components forming the circuit inside the instrument switch is kept very small. Mechanical fixations act simultaneously as electrical contacting. In this way the assembly and component expenditures of the instrument switch are reduced, because of which the instrument switch can also be produced very cost-effectively. The small number of components also prevents undesired additional transmission resistances between the current-conducting components.

The instrument switch can be easily handled for connection to an external circuit. The contact terminal that electrically contacts the contact spring and the fixing spring to one another can advantageously be used to connect a further electrical consumer to the instrument switch. However, only the contact bridge is active as an on-off switch for this electrical consumer. The overcurrent protection integrated into the instrument switch is not effective for this consumer.

A very effective transmission of force is permitted between the individual components of the switching mechanism inside the instrument switch, which components respectively act as levers. This additionally supports the reliable function of the switching mechanism. Furthermore, the levers act as a compact mechanical unit, and hence further contribute to the space-saving dimensioning of the instrument switch.

The switching position of the contact spring is signalized to the operating personnel. An optical signalization is provided. Because of the electrical wiring of the lamp and the series resistor with the contact spring, the lamp only illuminates when the contact spring is in its open position and the contact bridge is in the closed position of its contact, so that a voltage is applied to the illumination componentry. The lamp can be, for example, an incandescent lamp, a glow lamp or an LED.

BRIEF DESCRIPTION OF THE DRAWINGS

The subject matter of the invention is described in detail below with reference to the embodiment illustrated in the drawing figures. Shown are in.

DETAILED DESCRIPTION OF THE PREFERRED EMBODIMENTS

Figure 1:
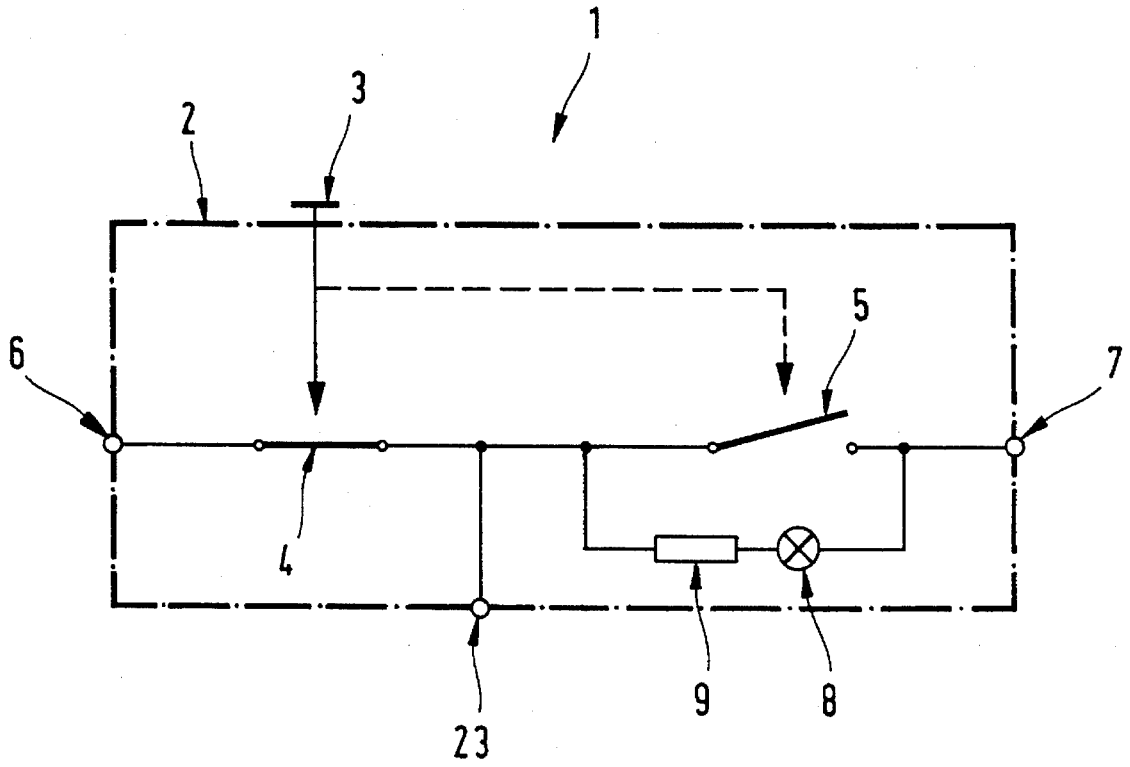
FIG. 1 a schematic circuit diagram of the instrument switch of the invention, FIG. 2 an exploded representation of essential components of the instrument switch, FIG. 3 a side sectional view of the instrument switch in its on position, with the contact spring and contact bridge being closed, FIG. 4 the side view of the instrument switch of FIG. 3 in its on position, but with the contact spring being open, FIG. 5 the side view of the instrument switch of FIG. 3, but in its off position and with the contact bridge being open, FIG. 6 a side view of the instrument switch along section line VI—VI in FIG. 3.

FIG. 1 illustrates the electrical functioning principle of a instrument switch. The switching mechanism of the instrument switch is disposed inside a plastic insulation housing 2. Components of the switching mechanism, a rocker switch 3, a contact bridge 4 and a contact spring 5, are schematically represented in FIG. 1. The rocker switch 3 is pivotably seated on the insulation housing 2. The instrument switch can be manually activated and deactivated by means of rocker switch 3. To do this, during its pivoting movements the rocker switch acts upon contact bridge 4. Consequently, depending on the switching position, contact bridge 4 closes or opens the circuit formed inside the insulation housing 2 between two contact terminals 6, 7. The two contact terminals 6, 7 serve to connect an electrical consumer, not shown here, and a voltage source, likewise not shown.

Contact bridge 4 and contact spring 5 are electrically connected in series between the two contact terminals 6, 7. Contact spring 5 exclusively acts to interrupt the circuit during overcurrent. For this purpose it includes a thermal triggering element that, when overcurrent occurs, triggers the transfer of contact spring 5 from its contact position into its open position that interrupts the circuit. The special design of contact spring 5 and the mechanical coupling between contact spring 5 ensures that contact spring remains in its open position after overcurrent trip, and can only be returned to its contact position by a rocker switch pivot. In this type of pivoting movement of rocker switch 3, contact bridge 4 is simultaneously transferred into its open position that interrupts the circuit. In this way the circuit at first remains interrupted, despite the return of contact spring 5 into its contact position. A further pivoting movement of rocker switch 3 is necessary to transfer contact bridge 4 from the open position of its contact into the closed position of its contact in order to re-close the circuit after overcurrent trip.

Without overcurrent trip, contact spring 5 remains in its contact position, independently of the pivot position of rocker switch 3. Contact spring 5 is connected electrically parallel to an illumination module comprising a lamp 8 and a series resistor 9. Lamp 8 is, for example, an LED. It does not illuminate until contact spring 5 is in its open position and an electrical voltage is applied to the two contact terminals 6, 7. Consequently, the overcurrent trip of instrument switch 1 is displayed visually for the operating personnel. The operator, executing a single pivoting movement of rocker switch 3, subsequently returns contact spring 5 to its contact position, and simultaneously transfers contact bridge 4 into the open position of its contact.

Whereas contact bridge 4 is designed for a very large operation cycle number because of the frequently-executed manual activation and deactivation of instrument switch 1, contact spring 5 can have a relatively small operation cycle number, because the switching position of contact spring 5 is only changed when overcurrent occurs.

Figure 2:
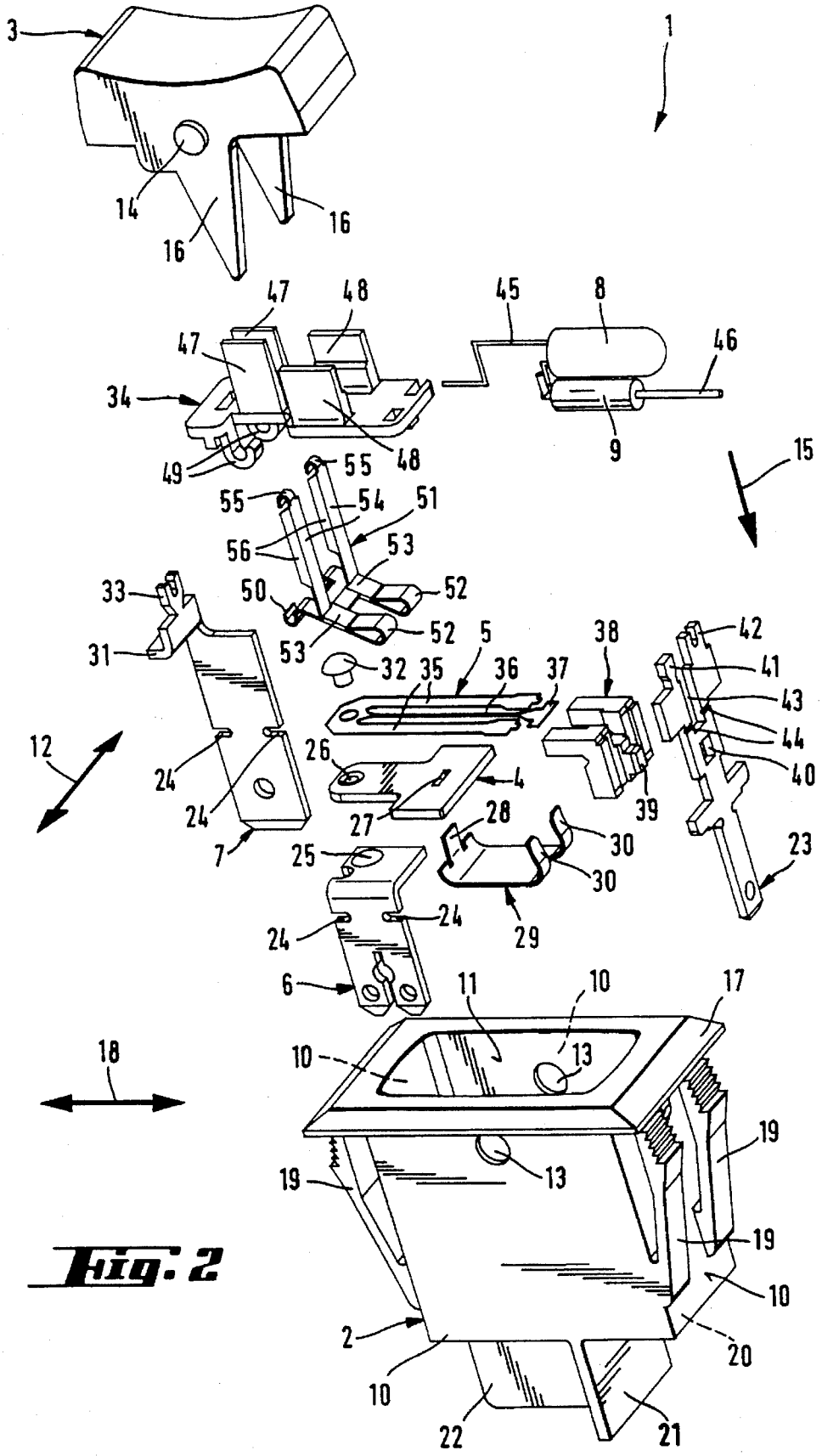

The housing walls 10 of insulation housing 2 in FIG. 2 define a shaft-like housing interior 11. Two housing walls 10 located opposite one another in a transverse direction 12 are each penetrated by a bearing bore 13. The two bearing bores 13 are aligned with one another in transverse direction 12. They serve in the positive-lockup reception of two axle journals 14 of rocker switch 3 for its pivotable seating on insulation housing 2. The two axle journals 14, of which only one axle journal 14 is visible in FIG. 2, are integral to rocker switch 3, which is typically made of plastic. Rocker switch 3 is inserted into the housing interior 11 in an insertion direction 15 at a right angle to transverse direction 12, and is latched in its inserted position with bearing bores 13. The two side walls of rocker switch 3 equipped with axle journals 14 are respectively extended wedge-like to have wedge tips that dip into housing interior 11 along insertion direction 15. This extension acts as a working end 16 in acting upon contact bridge 4.

In its inserted position (FIGS. 3 through 6), rocker switch 3 projects beyond insulation housing 2 counter to insertion direction 15. In this region rocker switch 3 is enclosed by a frame-like housing collar 17 with some degree of frictional lockup. Seen in insertion direction 15, housing collar 17 has a rectangular contour cross-section, as does insulation housing 2. In this cross-section plane, housing collar 17 projects on all sides from insulation housing 2. Housing collar 17 and housing walls 10 are connected to one another in one piece. Housing collar 17 also protects the components in housing interior 11 from mechanical damage.

Two locking arms 19 are integral to each of the two housing walls 10, which are located opposite one another in longitudinal direction 18. These locking arms extend along insertion direction 15, and serve to lock instrument switch 1 into, for example, a switchboard.

Longitudinal direction 18 extends at a right angle to transverse direction 12 and insertion direction 15.

Two partitions 21, 22 are integral to a housing bottom 20 of insulation housing 2 opposite housing collar 17 in insertion direction 15. The wall surface of partition 21 is located in a plane defined by insertion direction 15 and transverse direction 12. The wall surface of partition 22 is located in a plane defined by insertion direction 15 and longitudinal direction 18. Seen in insertion direction 15, the two partitions 21, 22 together form a T-shape. They divide the surface of housing bottom 20 into three approximately equal-sized surface sections. Contact terminals 6, 7, 23, which protrude in insertion direction 15 from housing bottom 20, are respectively associated with each surface section. Partitions 21, 22 provide electrical shielding of contact terminals 6, 7, 23 from one another.

Housing bottom 20 is provided with three throughgoing slots so that contact terminals 6, 7, 23 can be inserted into housing interior 11 during assembly of instrument switch 1 and can penetrate housing bottom 20. With frictional lockup, the slots enclose the contact terminal 6, 7, 23 respectively associated with them, thereby ensuring that contact terminals 6, 7, 23 are seated securely on the housing in a mechanically stable manner. An additional seating stabilization of contact terminals 6, 7 can be achieved in that their end regions projecting from housing bottom 20 are slightly twisted with respect to the regions located opposite them in housing interior 11. For this purpose two grooves 24 are cut into each respective contact terminal 6, 7 opposite longitudinal direction 18.

Contact terminals 6, 7, 23 are plate-like, electrically conductive contact pins. Contact terminals 6, 7 are located in a plane defined by insertion direction 15 and longitudinal direction 18. Inside housing interior 11, contact terminal 6 extends shorter than contact terminal 7, counter to insertion direction 15. The free end of contact terminal 6 inside housing interior 11 is angled off in transverse direction 12, and has the approximate shape of a rectangular plate. A fixed contact 25 is disposed on this plate. It is pressed as a tip out of the plate-like free end of contact terminal 6. In another embodiment, fixed contact 25 is configured as a rivet or small welded plate. Fixed contact 25 cooperates with a movable contact 26 that is pressed as a tip out of plate-like contact bridge 4. It is disposed in the region of a T-foot of the contact bridge 4, which, seen in insertion direction 15, is T-shaped. The T-top of contact bridge 4 is provided in insertion direction 15 with a throughgoing fixing slot 27. In the assembled state, a bearing web 28 oriented approximately parallel to insertion direction 15 penetrates fixing slot 27. Bearing web 28 is an integral component of a fixing spring 29. Seen in transverse direction 12, fixing spring 29 is U-shaped; bearing web 29 forms the one U-leg. The other U-leg is formed by two fixing webs 30 that are aligned in transverse direction 12. When the instrument switch is assembled, the two fixing webs 30 are securely connected mechanically to contact terminal 23, for example by means of welding. The result of the extension of spring web 28 into fixing slot 27 in the assembled state is a pivotable seating of contact bridge 4 on the housing. The pivot direction of contact bridge 4 is the same as or counter to insertion direction 15. Fixing spring 29 acts in the manner of a leaf spring with a spring force approximately in insertion direction 15. In this way the necessary contact pressure is produced between fixed contact 25 and movable contact 26 (FIG. 3) in the closed position of the contact of contact bridge 4.

Terminal contact 7 is extended around a fixed contact 31 counter to insertion direction 15. Fixed contact 31 is an integral component of contact terminal 7. It protrudes on one side from contact terminal 7 in transverse direction 12. Fixed contact 31 forms a plate-like stop surface for a movable contact 32 connected mechanically and electrically to contact spring 5. Fixed contact 31 is chamfered counter to insertion direction 15. The fixing peg 33, which extends counter to insertion direction 15, is integral at this angled region. Seen in longitudinal direction 18, this region is V-shaped. In the assembled state fixing peg 33 penetrates a correspondingly-shaped slot of the plate surface of an insulation plate 34 to be described below. In the assembled state the insulation plate 34 locks with fixing peg 33.

Figure 3:
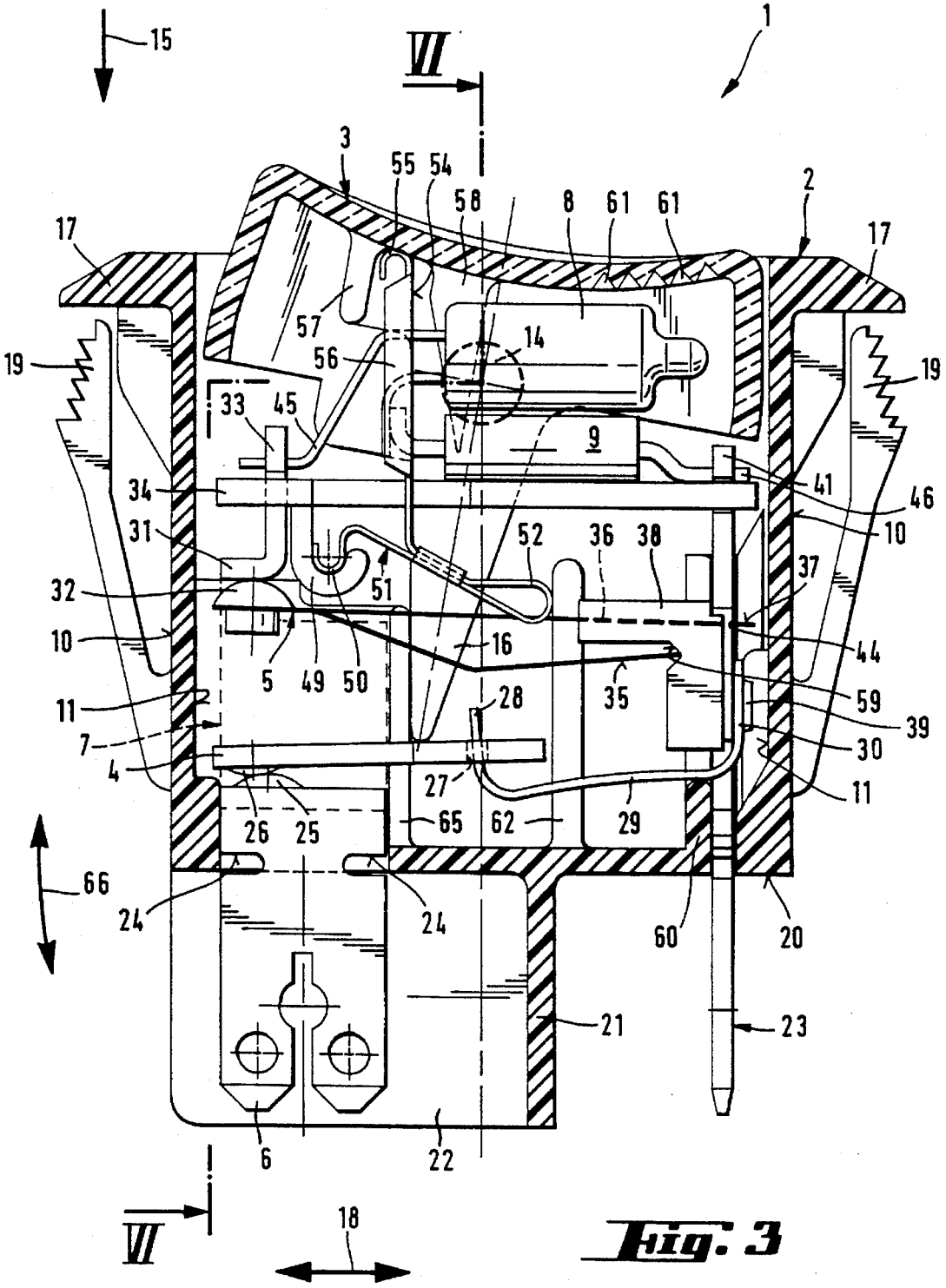

Contact spring 5 has a U-shaped, resilient metal strip having as its U-legs spring webs 35, which extend in longitudinal direction 18, and having a U-base extending in transverse direction 12. The U-base of this metal strip is penetrated by movable contact 32 in the assembled state of contact spring 5. A conducting web 36 likewise extending in longitudinal direction 18 is disposed centrally between the two spring web 36. Conducting web 35 is configured as a resistor wire and is integral to the U-base of the U-shaped metal strip. Conducting web 36 projects beyond spring webs 35 in longitudinal direction 18 with an approximately T-shaped web end 37. The clamping of contact spring 5, to be explained later with reference to FIG. 3, is effected at an insulating piece 38.

On the side facing contact terminal 23, insulating piece 38 is extended by an insulating peg 39 integral thereto. In the assembled state, the insulating peg penetrates a corresponding peg slot 40 of contact terminal 23 with positive lockup. Insulating piece 38 is stationarily secured to contact terminal 23 in the assembled state of the instrument switch. Peg slot 40 separates a cross-like part of contact terminal 23 that essentially protrudes from housing bottom 20 in the assembled state from an extension piece above peg slot 40 and oriented counter to insertion direction 15. Two fixing pegs 41, 42 are integral to the free end of this extension piece. In the assembled state fixing pegs 33, 41, 42 are disposed at approximately the same installation height. Like fixing peg 33, the two fixing pegs 41, 42 penetrate correspondingly-shaped slots of insulating plate 34. In this way insulating plate 34 is immovably seated. The two fixing pegs 41, 42 are separated in transverse direction 12 by a gap 43. Gap 43 is a groove-like cut made into contact terminal 23 that extends in insertion direction 15. In the region of its gap end, slightly above peg slot 40, gap 43 also separates two flutes 44 from one another. They are disposed on the side of contact terminal 23 that faces away from contact spring 5 in longitudinal direction 18, and extend in transverse direction 12. In the assembled state of instrument switch 1, they serve in bearing fixation of web end 37.

Fixing pegs 33, 42 are cut in groove-like in insertion direction 15. The cut in fixing peg 33 serves in the reception and electrical contacting of a connecting wire 45 of lamp 8, while the cut in fixing peg 42 is also defined in the same way for a connecting wire 46 of series resistor 9. The illumination module comprising lamp 8 and series resistor 9 is thus connected electrically parallel to contact spring 5.

Two identical plate walls 47 and two identical plate walls 48 are integral to the surface of insulating plate 34 facing rocker switch 3. Plate walls 47 and 48 are spaced from one another in transverse direction 12. The illumination module can be seated in a mechanically stable manner between the two plate walls 48. Plate walls 47 shield a restoring spring 51, which will be described below, from connecting wire 45.

Two receiving hooks 49 resembling crosiers are integral to the surface of insulating plate 34 facing away from rocker switch 3 in insertion direction 15. They are spaced from one another in transverse direction 12, and are aligned with one another in this direction. The free hook end of receiving hook 49 is bent in a semi-circle counter to insertion direction 15. It serves in the positive-lockup insertion of the correspondingly-bent bearing end 50 of a restoring spring 51. Bearing end 50 is a one-piece component of a resilient metal strip. The strip part of the metal strip that adjoins bearing end 50 is approximately oriented in longitudinal direction 18. This strip part is hence bent in the manner of a loop. The loop itself acts as a coupling end 52 for pressurizing a spring web 35 of contact spring 5. To mechanically maintain the shape of coupling end 52, the bent strip part and the non-bent strip part are connected to one another by a reinforcement tab 53.

Seen in transverse direction 12, restoring spring 51 is approximately T-shaped. The strip part that extends between bearing end 50 and coupling end 52 forms the cross T-leg, while a long spring leg 54 that adjoins the region of reinforcement tab 53 is oriented opposite insertion direction 15 and forms the long T-leg. The free end of long spring leg 54 is curved in a U-shape in insertion direction 15. The curved free end acts as a support end 55, and is supported against rocker switch 3 in the assembled state (FIG. 3). To reinforce long spring leg 54, a strip-like reinforcement tab 56 oriented in insertion direction 15 is integral thereto. Corresponding to the two spring webs 35, restoring spring 51 also has two identical, T-shaped spring parts. These two spring parts are spaced from one another in transverse direction 12, and are aligned with each other in this direction. They are connected to one another in one piece in the spacing region by a strip part of restoring spring 51. Restoring spring 51 can be produced from a single metal strip. This type of metal strip need only be pre-formed with corresponding recesses and bends.

All components of instrument switch 1 are shown in their assembled state in FIG. 3. The coupling of rocker switch 3 with contact spring 5 via restoring spring 51 can also be easily identified in FIG. 3. The U-shaped bearing end 50 is seated so as to be rotatably movable in receiving hook 49. Support end 55 is supported against the inside surface of rocker switch 3 facing insulating plate 34 in insertion direction 15. Two support stops 57, 58 are integral to this inside surface. They extend peg-like with a varying profile cross-section and varying length approximately in insertion direction 15. Support stops 57, 58 are spaced from one another in longitudinal direction 18. Support end 55 lies in the intermediate space formed by the spacing. Support stops 57, 58 ensure that restoring spring 51 can only deflect from its inserted position within certain limits. The seating of restoring spring 51 in the two receiving hooks 49, and its support in rocker switch 3, permit a spring-motion rotatability between long spring legs 54 and coupling ends 52. The imaginary axis of rotation extends in transverse direction 12 with the bending point between long spring leg 54 and the adjoining spring strip part as a plotted point for this axis of rotation. In this way a pivoting movement of rocker switch 3 can be converted into a spring force that acts upon spring webs 35.

Insulating plate 34 extends essentially over the entire housing interior 11 in longitudinal direction 18. It assures the necessary creep paths or clearance between the circuit and the service region, namely rocker switch 3.

Figure 4:
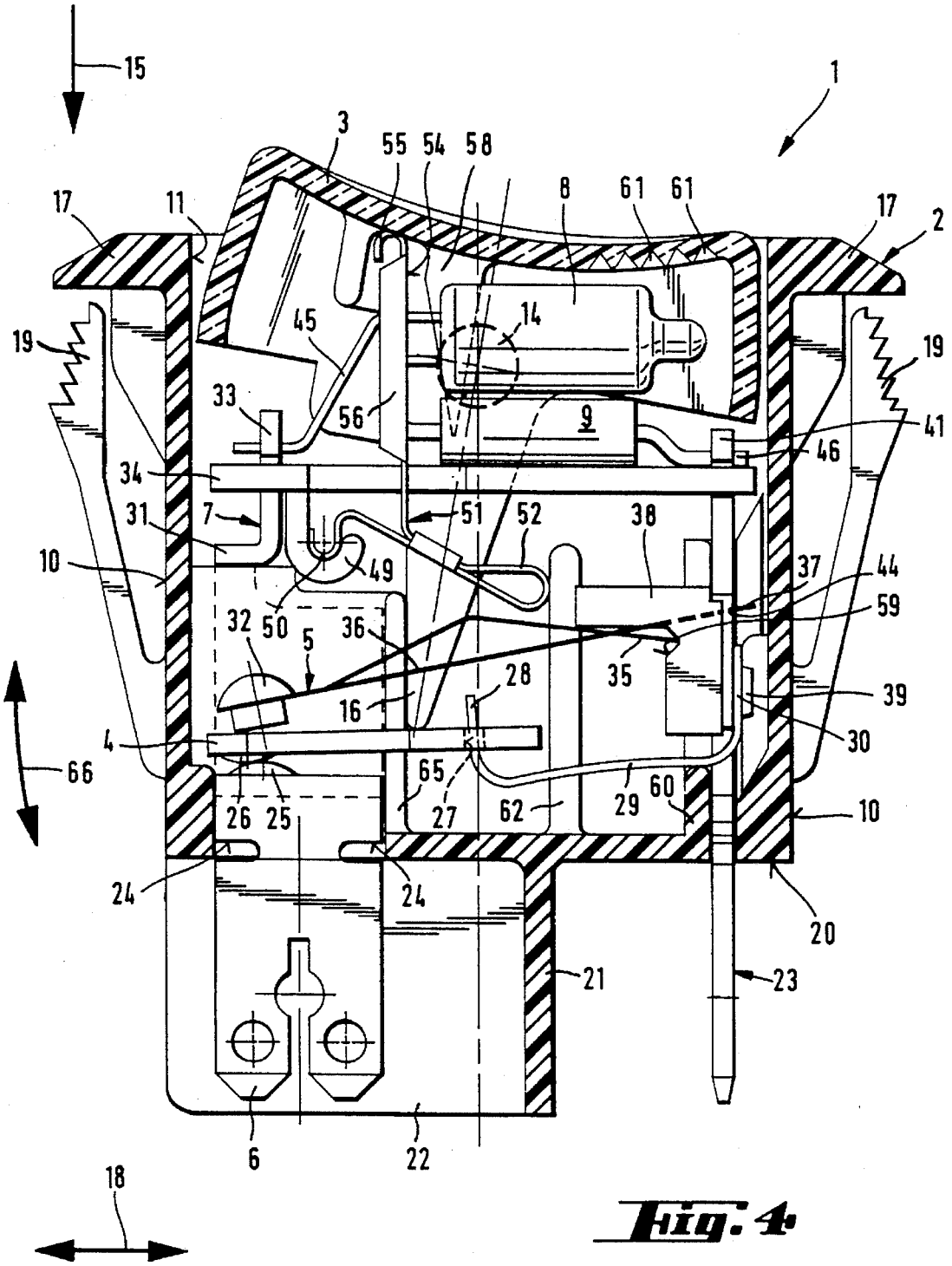

Contact spring 5 is clamped securely to the housing by its clamping end opposite the pivotable free end in longitudinal direction 18. The clamping end of contact spring 5 has web end 37 and the free ends of spring webs 35. Conducting web 36 penetrates gap 43 of contact terminal 23 and, with its web end 37, engages contact terminal 23 from behind. Web end 37 is fixed in clamping grooves 44 in the manner of a knife-edged bearing. The free ends of spring webs 35 are respectively supported in the manner of a knife-edged bearing in a V-shaped clamping groove 59 of insulating piece 38. Clamping grooves 59 are widened in the direction of movable contact 32 of contact spring 5. The spacing between clamping grooves 59 and clamping grooves 44 is selected such that, in the assembled state of contact spring 5, conducting web 36 is stressed with tensile force and the two spring webs 35 are bent. Spring webs 35 are therefore prestressed in the direction of rocker switch 3 (FIG. 4). Spring webs 35 are pressed into their position corresponding to the contact position of contact spring 5 (FIG. 3) by the spring force of coupling ends 52.

In its contact position, contact spring 5 is electrically contacted with contact terminal 6. To this end contact spring 5 rests with its movable contact 32 against fixed contact 31 under sufficient contact pressure. In this position contact spring 5 is not acted upon by restoring spring 51.

In FIG. 3, contact bridge 4 is in the closed position of its contact and is electrically contacted with contact terminal 6. Movable contact 26 rests with sufficient contact pressure against fixed contact 25. Contact bridge 4 is a two-armed lever seated to pivot on bearing web 28 of fixing spring 29. The lever arm of contact bridge 4 provided at its free end with movable contact 26 is pressed against fixed contact 25 by the corresponding prestressed fixing spring 29. The pivot path of working end 16 is limited by a limiting stop 65 secured to the housing. In the closed position of the contact of contact bridge 4, working end 16 rests against limiting stop 65, which extends counter to insertion direction 15. Working end 16 is seated on this lever arm of contact bridge 4. In this way contact bridge 4 remains reliably in the closed position of its contact during the pivoting movement of rocker switch 3 illustrated in FIG. 3. Fixing spring 29 itself is a one-armed lever. Fixing spring 29 can be pivoted with its bearing web 28 as a free end, while its imaginary pivoting axis is disposed in the region of its support on the housing. The housing-secure support of fixing spring 29 is effected by means of welding fixing webs 30 and by means of it being supported on a support peg 60. Support peg 60 is integral to housing bottom 20 and extends counter to insertion direction 15. Support peg 60 also flanks contact terminal 23 to improve its attachment to the housing.

Figure 5:
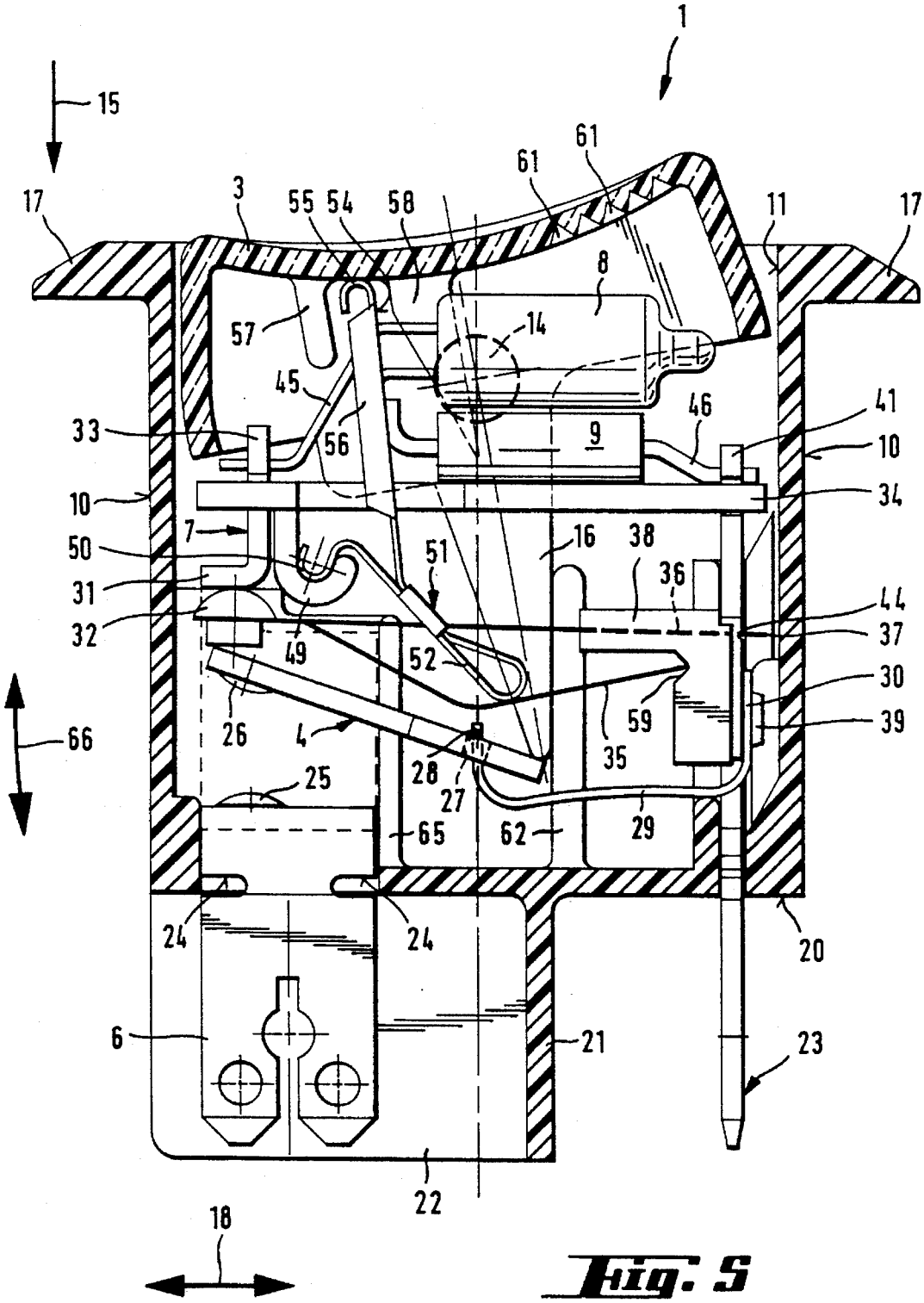

In FIG. 3, instrument switch 1 is in its on position. By means of pivoting of rocker switch 3, instrument switch 1 can be transferred manually into its off position (FIG. 5). Working end 16 moves along longitudinal direction 18 in the direction toward the lever arm of contact bridge 4 that is not acted upon in FIG. 3. Contact bridge 4 is thus pivoted clockwise by working ends 16. Contact bridge 4 is transferred into the open position of its contact; the circuit inside instrument switch 1 is hence interrupted.

The circuit inside instrument switch 1 has the following sequence:

contact terminal 6
fixed contact 25
movable contact 26
contact bridge 4
fixed spring 29
contact terminal 23
conducting web 36
movable contact 32
fixed contact 31
contact terminal 7.

A new pivoting of the rocker switch allows contact bridge 4 to be transferred back into the closed position of its contact.

In the contact position of contact spring 5 (FIG. 3), the two spring webs 35 are fixed counter to their prestress, as described above. When overcurrent occurs, conducting web 36 is rotated strongly with respect to spring webs 35 in longitudinal direction 18. The great expansion between conducting web 36 and spring webs 35 is permitted in that the current only flows through conducting web 36. The conducting web is connected electrically to the circuit at one end via web end 37 and at the other end via movable contact 32. Spring webs 35, in contrast, are secured to the insulating piece 38 made of insulating material. The spacing between clamping grooves 44, 59 is very small so that the expansion of insulating piece 38, which is conventionally made of plastic, does not influence the expansion ratios between conducting web 36 and spring webs 35. If conducting web 36 reaches a certain length as a consequence of overcurrent-related expansion, the normal prestress of spring webs 35 is greater than the clamping shown in FIG. 3. At this moment contact spring 5 tips in tipping direction 66, which extends parallel to insertion direction 15, i.e., spring webs 35 snap beyond the dead center position, counter to the insertion direction, and into their position that corresponds to the normal prestress (FIG. 4). Because the clamping of spring webs 35 shown in FIG. 4 also corresponds to its normal clamping in the assembled state, contact spring 5 remains reliably in its open position without pivoting of rocker switch 3.

If contact spring 5 was transferred into its open position by means of overcurrent, contact bridge 4 is nevertheless first in the closed position of its contact (FIG. 4). If further electrical voltage is applied to the circuit, operating personnel are notified visually by illuminating lamp 8. For better recognition of the lamp light, a plurality of prisms 61 are inserted into rocker switch 3, which is made of transparent plastic.

The operating personnel will now transfer rocker switch 3 from the pivot position shown in FIG. 4 into the pivot position shown in FIG. 5. During this the two coupling ends 52 of restoring spring 51 are pivoted clockwise, and thus pressurize the two spring webs 35 in insertion direction 15. Contact spring 5 again tips in tipping direction 66 and is thereby guided back into its contact position. At the same time, working end 16 of rocker switch 3 is rotated clockwise. It therefore pressurizes the shorter lever arm of contact bridge 4, as in the off position of instrument switch 1. In the new pivot position of rocker switch 3, working end 16 impacts upon a limiting stop 62. Limiting stop 62 is integral to housing bottom 20, and extends counter to insertion direction 15. It limits the pivot path of working end 16 counterclockwise. This ensures that working end 16 is always in engagement with contact bridge 4 during the pivoting movement of rocker switch 3 shown in FIG. 5. Contact bridge 4 thus remains reliably in the open position of its contact without re-pivoting of the rocker switch.

Figure 6:
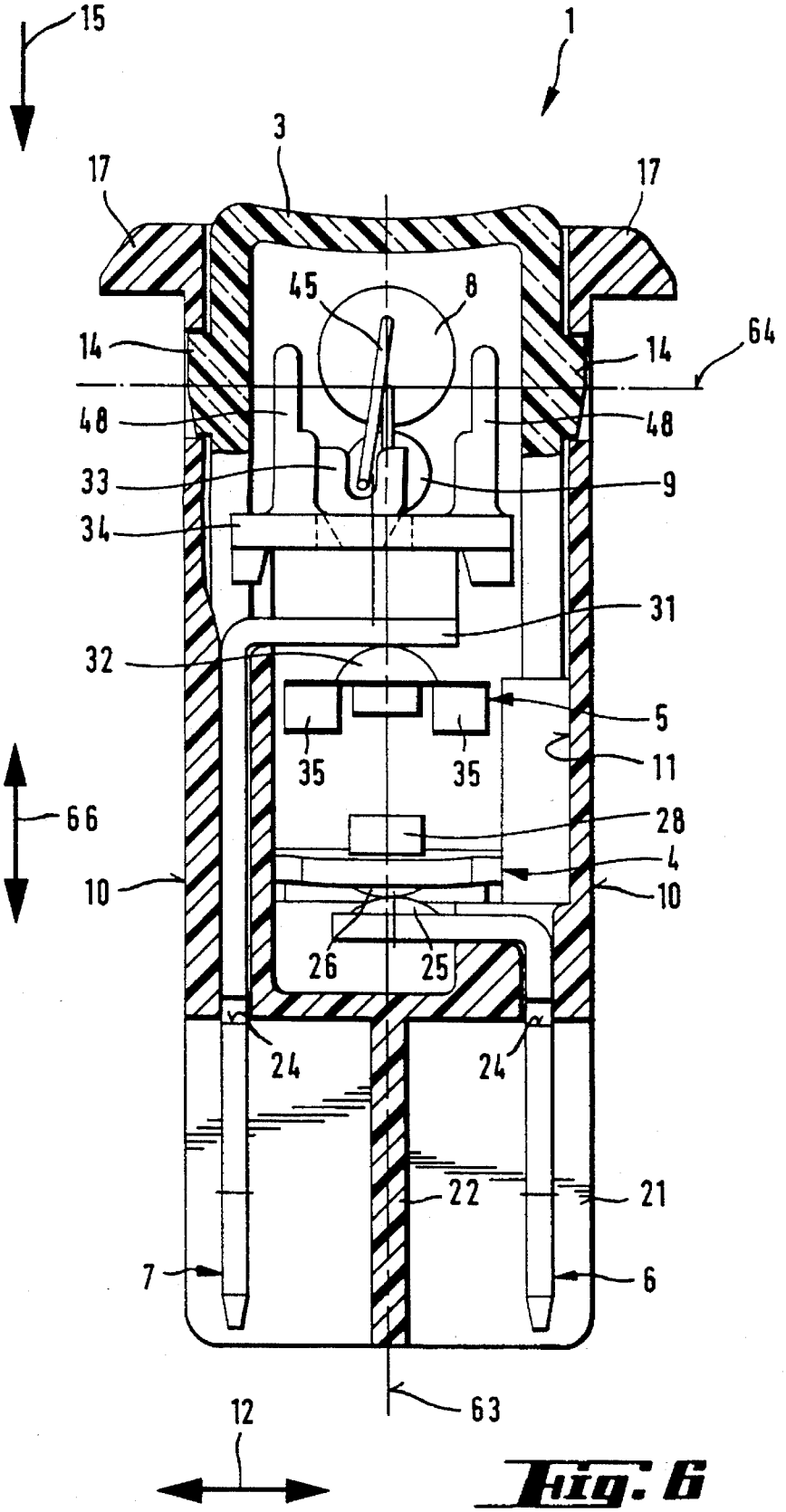

It can be seen in FIG. 6 that instrument switch 1 is designed axisymmetrically with essential function components with respect to an axis of symmetry 63 that is parallel to insertion direction 15. This contributes to the space-saving, compact design of instrument switch 1. The axes of rotation of all components of instrument switch 1 configured as levers are disposed parallel to transverse direction 12, as is a rocker switch axis 64 of rocker switch 3. This also contributes to the compact, small structure and simple design of instrument switch 1.

It will be understood that the above description of the present invention is susceptible to various modifications, changes and adaptations, and the same are intended to be comprehended within the meaning and range of equivalents of the appended claims.

We claim:

1. A manually-operated, electrical instrument switch comprising:

an insulating housing having an interior;

a contact bridge within the interior that is movable between a closed contact position and an opened contact position;

a rocker switch pivotally seated in said insulating housing and including a working end that dips into the housing interior for moving said contact bridge between the closed contact position and opened contact position; and a contact spring being electrically connected in series with said contact bridge, and including a rocker-snap mechanism movable in first and second directions for moving said contact spring between a respective contact position and an open position, and a thermal triggering element for overcurrent protection, said rocker-snap mechanism being fixed to be permanently mechanically prestressed in the second direction, whereby the contact spring is fixed in its contact position counter to the mechanical prestress and is transferred into its open position by said thermal triggering element during overcurrent, and is guided back into its contact position from its open position by pivoting said rocker switch causing said rocker-snap mechanism to move in the first direction counter to the mechanical prestress.

2. A switch as defined in claim 1, wherein said rocker switch includes a lever arm, and wherein said contact bridge and said contact spring extend approximately parallel to the lever arm of the rocker switch.

3. A switch as defined in claim 1, wherein the contact spring is disposed between the rocker switch and the contact bridge.

4. A switch as defined in claim 1, wherein the contact bridge, the rocker switch, and the contact spring are pivotably seated in the same plane of movement and have parallel pivoting axes.

5. A switch as defined in claim 1, wherein the contact spring has a fixed end and a movable end, the fixed end being clamped to the housing and the movable end being pivotable between the contact position and open position.

6. A switch as defined in claim 5, wherein the contact spring movable end includes a movable contact for contacting with a circuit.

7. A switch as defined in claim 5, wherein said contact spring comprises two parallel spring webs and said thermal triggering unit comprises a metallic conducting web therebetween, the contact spring being clamped to the housing whereby the metallic conducting web is clamped shorter than the spring webs.

8. A switch as defined in claim 1, wherein the contact spring has a clamped, fixed end comprising a conducting web that is electrically contacted to a circuit.

9. A switch as defined in claim 7, wherein the metallic conducting web has a high thermal expansion coefficient.

10. A switch as defined in claim 1, wherein pivoting said rocker switch counter to the mechanical prestress causes said rocker switch to pressurize the contact spring.

11. A switch as defined in claim 7, wherein the rocker switch acts upon the two spring webs of the contact spring.

12. A switch as defined in claim 10, further comprising a coupling element mechanically connected to the rocker switch for acting upon said contact spring.

13. A switch as defined in claim 12, wherein the coupling element is a spring element.

14. A switch as defined in claim 13, wherein the coupling element is a T-shaped restoring spring having a cross-leg and long spring leg being resiliently rotated opposite one another around their point of connection, said restoring spring being located in a pivoting plane of the rocker switch, and being acted upon by said contact spring.

15. A switch as defined in claim 14, wherein the long spring leg is seated on the rocker switch and wherein the cross leg has two free ends, one free end acting as a coupling end and acting upon the contact spring, the other free end acting as a bearing end and being rotatably seated on a side of the housing.

16. A switch as defined in claim 15, wherein the restoring spring has two coupling ends for respectively acting upon a spring web of the contact spring.

17. A switch as defined in claim 1, and further comprising a fixing spring for pivotally seating the contact bridge on the insulation housing, and wherein the contact bridge comprises a two-armed lever, each lever arm being acted upon by the rocker switch in the closed contact position and the open contact position, respectively, said lever arms being directly acted upon by the working end of the rocker switch.

18. A switch as defined in claim 17, wherein the fixing spring has an end secured to the housing whereby said fixing spring functions as a one-armed lever, and wherein the contact bridge is seated on a portion of the fixing spring remote from the secured end.

19. A switch as defined in claim 17, wherein the fixing spring comprises a leaf spring prestressed in the direction of the closed contact position of the contact bridge and being approximately parallel to the contact bridge.

20. A switch as defined in claim 18, wherein the fixing spring has a U-shaped cross-section having a U-yoke extending approximately parallel to the contact bridge, and wherein one U-leg is a fixing web secured to the housing, and the other U-leg is a bearing web that penetrates a bearing recess of the contact bridge for the pivotable seating.

21. A switch as defined in claim 17, wherein the contact bridge is seated on to be electrically contacting with the fixing spring.

22. A switch as defined in claim 1, further comprising a fixing spring being electrically contacted with said contact spring, and wherein the contact spring and the fixing spring are secured to the housing.

23. A switch as defined in claim 22, wherein the contact spring and the fixing spring are fixed to an electrically-conductive contact terminal secured to the housing.

24. A switch as defined in claim 1, further comprising contact terminals, and wherein the contact spring and the contact bridge are electrically contacted with a respective contact terminal.

25. A switch as defined in claim 23, wherein the contact terminals protrude pin-like from the insulation housing.

26. A switch as defined in claim 1, further comprising a fixing spring for pivotably seating said contact bridge on the insulating housing, and a restoring spring for operatively connecting said contact spring with said rocker switch, wherein the rocker switch, contact spring, fixing spring, restoring spring, and contact bridge are each pivotally seated in the same plane of movement and have parallel pivoting axes.

27. A switch as defined in claim 1, wherein the switching position of the contact spring is visually displayed.

28. A switch as defined in claim 27, wherein an illumination module comprising a lamp and a series resistor is connected electrically parallel to the contact spring as a visual display.

* * * * *